US006848357B2

(12) United States Patent
Linnonmaa et al.

(10) Patent No.: US 6,848,357 B2
(45) Date of Patent: Feb. 1, 2005

(54) METHOD FOR CONTROLLING THE TEMPERATURE OF A HEATED ROLL IN A CALENDER

(75) Inventors: Pekka Linnonmaa, Järvenpää (FI); Juhani Partanen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 54 days.

(21) Appl. No.: 10/366,590

(22) Filed: Feb. 13, 2003

(65) Prior Publication Data

US 2003/0209156 A1 Nov. 13, 2003

(30) Foreign Application Priority Data

Feb. 15, 2002 (FI) ..... 20020303

(51) Int. Cl.[7] ..... B30B 15/34; H05B 6/06

(52) U.S. Cl. ..... 100/38; 100/308; 100/329; 100/330; 100/332; 100/335; 100/336; 162/358.5

(58) Field of Search ..... 100/38, 41, 92, 100/305–309, 327–336; 162/13, 50, 118, 121, 122, 289, 359.1, 358.1–358.5; 492/20, 46

(56) References Cited

U.S. PATENT DOCUMENTS 4,614,565 A 9/1986 Riihinen
4,653,395 A * 3/1987 Verkasalo ..... 100/38
4,875,297 A 10/1989 Zaoralek
5,076,891 A 12/1991 Link et al.
5,079,817 A 1/1992 Anstötz et al.
5,895,598 A 4/1999 Kitano et al.
6,368,458 B1 * 4/2002 Graf et al. ..... 162/206

FOREIGN PATENT DOCUMENTS

CA 2119940 A1 10/1994

* cited by examiner

*Primary Examiner*—Allen Ostrager
*Assistant Examiner*—Shelley Self
(74) *Attorney, Agent, or Firm*—Alston & Bird LLP

(57) ABSTRACT

A method for controlling the temperature of a heated roll in a calender is provided. The calender comprises at least one heated roll or thermoroll and at least one backing roll, between which is formed a nip through which the material web is conveyed. To the heated roll is supplied internal thermal power by internal heating means of the roll, and external thermal power by external heating means of the roll. Before changing the heated roll, internal thermal power is minimized within a specific period by control means provided in conjunction with the internal heating means; external thermal power is maximized within a specific period by control means provided in conjunction with the external heating means; and the surface temperature of and/or the thermal power released by the heated roll, which corresponds to the surface temperature and/or thermal power desired for the grade of the material web, is maintained within a specific period. The present invention further provides a method for changing the material web grade to another grade.

16 Claims, 1 Drawing Sheet

METHOD FOR CONTROLLING THE TEMPERATURE OF A HEATED ROLL IN A CALENDER

BACKGROUND OF THE INVENTION

1. Field of the Invention

The present invention relates to a method for controlling the temperature of a heated roll in a calender, the calender comprising at least one heated roll or thermoroll and at least one backing roll, between which is formed a nip, through which the material web is conveyed, and to which heated roll or thermoroll is supplied internal thermal power by internal heating means of the roll or thermoroll, and external thermal power by external heating means of the roll or thermoroll.

2. Description of Related Art

Previously are known thermorolls or heated rolls which are used in the finishing of, for example, paper or other similar material, especially for improving/altering the quality of a material web formed of paper. In basic operation, heat or thermal power is supplied to the thermorolls continuously to heat the mantle of the thermoroll and maintain it at a constant temperature. Through the outer shell of the roll, that is, the mantle, the thermal power corresponding to the desired grade of the web material is transferred to the paper web. The thermal power correlates with the temperature of the roll mantle surface.

Also previously are known two methods for heating the roll, which differ in basic principle. The first uses internal heating, where heated heating medium such as water, steam or oil is fed inside the roll. The second method uses external heating, applying external heating means. Such heating means can be, for example, induction heating elements arranged axially in the vicinity of the roll mantle, blasting elements or elements intended for infrared heating.

One structure of an induction heating element is described in the U.S. Pat. No. 5,895,598, which concerns placing inductive elements also inside the roll to effect more even distribution of heat inside the roll.

The roll may also be heated with external and internal heating means simultaneously. Finnish patent application 882865 discloses an arrangement of this type, the purpose of which is to maintain, by means of additional external heating means, as accurately as possible a temperature balance in the radial direction of the roll. The balance is susceptible to change, especially at a moment when the transfer of the thermal power supplied from the roll mantle to the web material changes. Such moments include start-up, stopping, and change of grade of the web material.

The problem with such rolls concerns long heating and cooling times due to the large mass of the roll. When a thermoroll is heated with oil, the roll may be heated or cooled preferably by about 1 to 3 degrees centigrade per minute. When the grade of the material web is changed during running, the production of the web grade must be discontinued at the moment when the roll temperature dependent on the thermal power transferred from the roll to the web material changes. A new grade cannot be run until the temperature of the roll surface (mantle), in practice, the temperature of the entire roll, has changed to correspond to the new grade. The same problem occurs when the heated roll is cooled before changing.

SUMMARY OF THE INVENTION

The aim of the present invention is to provide a method in which the foregoing disadvantages will diminish and has been achieved by means of the present invention in such a way that, before the moment of changing the heated roll or thermoroll:

internal thermal power is minimized within a specified period by control means provided in conjunction with the internal heating means;

external thermal power is maximized within a specified period by control means provided in conjunction with the external heating means;

the surface temperature of and/or the thermal power released or emitted by the heated roll or thermoroll, which corresponds to the surface temperature and/or thermal power desired for the grade of the material web, is maintained within a specified period.

This aim is further achieved according to the present invention in such a way that before the moment when the grade of the material web traveling through the heated roll or thermoroll is changed into another grade:

the internal thermal power is adjusted close to the internal thermal power required for another material web grade, within a specified period, by control means provided in conjunction with the internal heating means;

the external thermal power is adjusted within a certain period by control means provided in conjunction with the external heating means; and the surface temperature of and/or the thermal power released or emitted by the heated roll or thermoroll, which corresponds to the surface temperature and/or thermal power desired for the grade of the material web, is maintained within a specified period.

Preferred embodiments of the present invention are disclosed in the dependent claims.

BRIEF DESCRIPTION OF THE DRAWING(S)

The present invention is described in the following with reference to the accompanying drawings, of which:

DETAILED DESCRIPTION OF THE INVENTION

Figure 1:
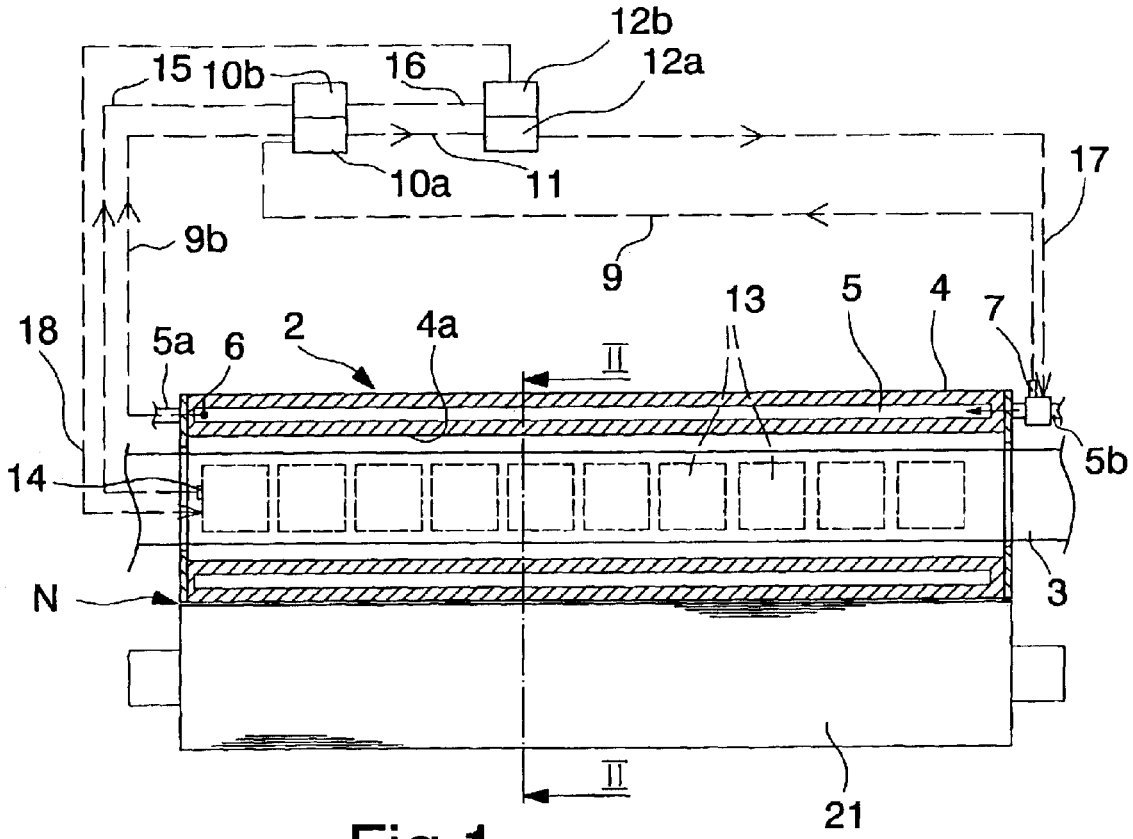
FIG. 1 shows a diagrammatic view of a roll according to the invention.
Figure 2:
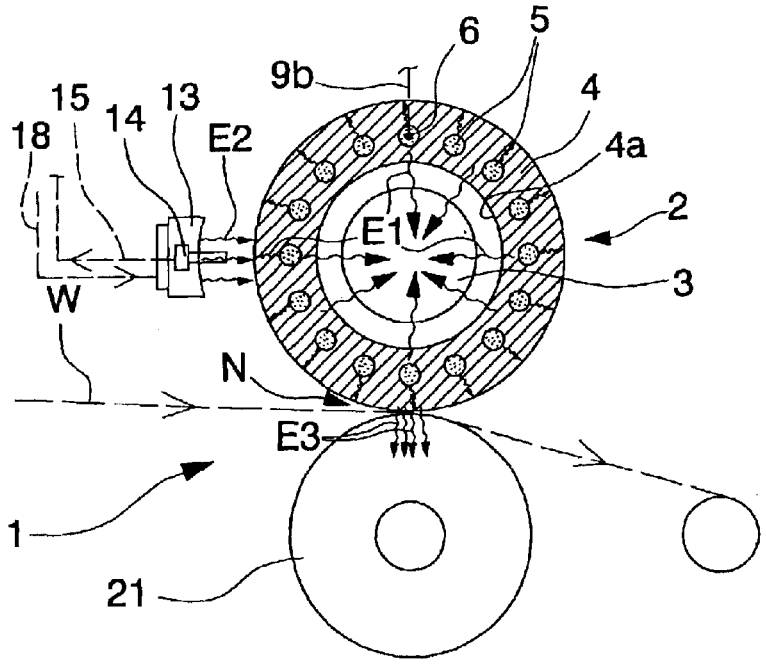
FIG. 2 shows a sectional view of FIG. 1 along line II.

FIGS. 1 and 2 show a view in principle of an apparatus applying the methods according to the invention. The Figures show a part of the calender 1, in which the heated roll or thermoroll is marked with reference numeral 2. Against the roll mantle 4 of the thermoroll 2 is arranged a backing roll 21, which forms a nip N with the thermoroll 2. The material web W has been conveyed through the nip N. The material of the web W is usually board or paper.

The mantle 4 of the thermoroll 2 rotates around a stationary shaft 3. On the roll mantle 4, parallel to the longitudinal axis of the thermoroll 2, are preferably formed internal heating means 5 comprising peripheral ducts for the heated medium. In this embodiment, the ducts form the internal heating means 5 of the thermoroll 2. The heated medium usually used is a liquid or a liquid-emulsion, for example, water, steam or oil, of which oil generates the highest internal thermal power E1 to the supplied to the external parts of the roll 2, and the temperature proportional to it. The medium is heated by means of a heater (not shown) before feeding it inside the peripheral ducts or the internal heating means 5 formed inside the roll mantle 4. The internal heating means 5 may be other types of heating means, such as induction heating elements arranged, for example, on a stationary shaft 3.

Outside the thermoroll 2, in the vicinity of the roll mantle 4, are arranged external heating means 13, which are induction heating elements in this embodiment. They are preferably arranged next to each other or in some other suitable manner in the longitudinal direction of the roll, over the entire lateral direction of the material web W. The induction heating elements forming the external heating means 13 are arranged in such a way that they will provide an even distribution of heat on the surface of the roll mantle 4.

The induction heating element is structurally an induction heating element complying with current prior art, which has a magnetic core surrounded by an induction coil. To the coil is supplied, for example, by means of external current feed systems (not shown), an alternating current, which forms a magnetic flux in the induction heating element. With output power, the magnetic flux extends to the surface of the roll mantle 4, where an induction current is generated, as a result of which, an external thermal power E2 proportional to the output power of the induction heating element can be conducted to the surface part of the roll mantle 4. As external heating elements can also be used infrared heaters and fans.

In conjunction with the thermoroll 2 are further arranged control means for the internal beating means 5, wherein such control means include a transmission path 9, a converter 10*a*, a transmission path 11, a control device 12*a*, and a transmission path 17. Control means for the external heating means 13 is also provided, wherein such control means include a sensor 14, a transmission path 15, a converter 10*b*, a control device 12*b* and a transmission path 18. The control means of the internal heating means 5 also include a sensor or the like 7. The purpose of the sensor 7 is to detect, for example, the temperature of the medium at which it is supplied in the ducts of the internal heating means 5 formed in the roll mantle 4. Alternatively, or in addition to the above, on the sensor 7 can also be detected the output power of the heating apparatus, which is proportional to the temperature desired for the heated medium and further to the thermal power E1 generated by the internal heating means 5 of the thermoroll 2. For the sensor 7 is provided a transmission path 9, which is in contact with the converter 10*a*. In the convertor 10*a*, the signal or message received from the sensor 7 is converted, for example, into a voltage signal and transmitted further along the transmission path 11 to a control device 12*a* as control signal. The control device 12*a* comprises a memory unit, a logic or corresponding unit h means of which the control device determines the power requirement to be supplied to heating apparatus, which is proportional to the internal thermal power requirement E1. From the control device 12*a* is transmitted a control signal to the heating apparatus along the transmission path 17.

The control means of the external heating means 13 include a sensor or the like 14, which is arranged in conjunction with the induction heating element. The purpose of the sensor 14 is to detect the temperature of the induction heating element, or correspondingly, instead of or in addition to it, the output power of the induction heating element. The output power is proportional to the external thermal power requirement E2 supplied to the surface of the thermoroll 2. By means of the sensor 14 can, in addition to the foregoing or alternatively, also be detected the surface temperature of the thermoroll 2.

From the sensor 14 to the converter 10*b*, is arranged a transmission path 15 by means of which information on the output power of the induction heating element of the external heating means 13 or on the temperature or surface temperature of the thermoroll 2 is transmitted to the converter 10*b*. In the converter 10*b*, the signal or message received from the sensor 14 is converted, for example, into a voltage signal and transmitted further along transmission path 16 to the control device 12*b* as a control signal. Also the control device comprises a memory unit, logic or corresponding unit by means of which the control device 12*b* determines the thermal power requirement to be supplied to the induction heating element, which is proportional to the external thermal power E2 requirement. The control device 12*b* gives a control signal to the induction heating elements along the transmission path 18.

The invention is described in greater detail in the following, by way of an example, when applied to the device arrangement of the thermoroll 2 disclosed above. As concerns the apparatus, the invention may also be applied and implemented in a different manner, for example, by using different internal and external heating means.

The material web W is run through a nip N formed by the thermoroll 2 and the backing roll 21. The material of the material web W is, for example, paper, which is to become paper of a certain grade once it has passed through the nip N of the calender 1. This has been achieved especially by bringing the surface of the paper web W against the surface of the thermoroll 2, where it is worked so as to become characteristic of a particular paper grade. This working is effected substantially by the thermal power E3 released by the thermoroll 2, which is proportional to the temperature of the thermoroll 2 mantle 4. This temperature of the mantle 4 and the thermal power E3 are maintained during running by supplying internal thermal power E1 to the roll by means of the internal heating means 5, and external thermal power E2 by means of the external heating means 13, the joint effect of which constitutes thermal power E3.

During running proper, preferably as small as possible a temperature difference is maintained in the radial direction of the thermoroll 2. This is achieved by distributing evenly the thermal power brought to the roll 2 with respect to the thermal powers E1 and E2 heating the thermoroll 2. The thermoroll 2 must be cooled before it is changed. In accordance with the present invention, from the commencement of cooling the thermoroll to the actual point of exchange the following takes place in stages.

Firstly, the decreasing of internal thermal power E1 is begun by adjusting the temperature of the internal heating means 5 with the control means therefor. The internal thermal power E1 may be decreased, for example, progammatically by control means of the internal heating means, so that the internal temperature of the thermoroll 2 will decrease substantially evenly. The thermal powers of the heater are decreased, for example, so that the internal temperature of the roll 2 will decrease by 3° C./min. Preferably, the temperature is decreased by about 1° C./minute to 3° C./minute, depending on the size and structure of the thermoroll. Programmatic control can be used especially in cases where the heat-conducting properties of the roll type and the change in the changing internal thermal power E1 with respect to the temperature of the thermoroll 2 are known. Instead of or in addition to programmatic control, the internal temperature of the thermoroll 2 can also be monitored by means of a temperature sensor 6 or the like, which may also form a part of the control means of the internal heating means 5, or by means of several sensors located in the longitudinal direction and/or radial direction of the roll 2. The information on the internal temperature of the roll obtained from the temperature sensor 6 is transmitted along the transmission path 9*b* (which may also be a part of the control means for the internal heating means 5) to the converter 10*a*. Further on the basis or this information, the control device 12*a* will decipher the thermal power requirement of the heating apparatus.

Due to the decrease in the power supplied to the internal heating elements 5, also the thermal power E1 supplied to the inner parts of the thermoroll 2 and partly to the external parts also decreases. The temperature in the inner parts and external parts of the thermoroll 2 will thus begin to decrease.

The external thermal power E2 provided by means of the external heating means 13 is increased at the same time as the internal thermal power E1 is decreased. The increase in the external thermal power E2 may be carried out, for example, by increasing the power supplied to the induction heating elements 13 programmatically by means of the control device 12*b*. By this increase in external thermal power E2 is compensated for the decrease in the surface temperature of the thermoroll 2 due to the decrease in the internal thermal effect E1 and maintained the temperature of the surface of the roll mantle 4 of the thermoroll 2 at the temperature required by the material web W grade being run. In this way is additionally ensured that the thermoroll will release heat outside, that is, to the web material W, at the correct thermal power E3 at the same time as the inner parts of the thermoroll 2 are being cooled.

Within a specific period, the inner parts of the thermoroll 2 will cool to a temperature allowing the change of the thermoroll 2 or to the lowest temperature to which the inner parts of the thermoroll 2 (mainly the roll mantle) can be cooled in the radial direction compared with the running temperature of the external parts of the thermoroll 2. The internal thermal power E1 is minimized with respect to the roll 2, and the external thermal power E2 is maximized with respect to the roll 2. The specific time period will thus be determined separately for each roll and will depend on the cooling rate of the inner parts of the roll 2, which may be, for example, the 3° C. per minute mentioned above, and on the temperature prevailing in the roll at the moment when cooling is started.

When the internal thermal power E1, and thus the internal temperature, reach the minimum value at which the web material W is run, the external thermal power E2 will reach its maximum value, while the thermal power E3 released by the surface of the roll 2 and/or the temperature remain essentially constant. After this, the external thermal power E2 can be decreased rapidly compared with the decreasing of the internal thermal power E1 to a value at which the surface temperature of the roll mantle 4 will decrease essentially to the same level as the cooled or to a great extent cooled inner parts of the thermoroll 2. At the same time as the external thermal power E2 begins to be decreased, the running of the grade is discontinued. Only then will the thermal power E3 characteristic of the grade being run and released by the thermoroll 2 become essentially unfavorable for the grade being run.

An advantage of the method described above over the prior art is that the web material W being run can be run at the same time as the thermoroll 2 is being cooled. Previously, the manufacture of the grade was discontinued at that moment when the cooling of the thermoroll 2 was begun. The reason for this was that because of the heat transfer and control of the thermoroll 2 the surface of the roll began to cool immediately at the same time as the powers required for heating began to be decreased. The time saved by the method according to the invention is thus considerable. The slow cooling taking place by means of the interior heating means cannot be speeded up due to structural aspects relating to the thermoroll. In such a case it is a considerable advantage that the internal thermal power E1, and thus the internal temperature, can be decreased "in advance" compared with the moment of changing the thermoroll 2, while at the same time driving the material web W through the nip N formed by the thermoroll 2 and the backing roll 21 without discontinuing the manufacture of the material web W grade or without changing the grade of the web W.

In another embodiment of the invention, by means of the method according to the teaching of the first embodiment, one can be prepared "in advance" to change the grade of the material web W without changing the thermoroll 2, as follows. In this embodiment, changing to another grade requires that the thermal power E3 released by the thermoroll 2 according to the first embodiment and/or the temperature of the external parts of the roll 2 is increased.

Alternatively, changing to another grade requires that the thermal power E3 released by the thermoroll 2 and/or the temperature of the external parts of the roll 2 is decreased. This idea is easy to understand on the basis of the previous embodiment and the following example, and thus it is not disclosed herein. This idea can, however, be included within the scope of protection presented.

The material web W, for example, a paper web, is run through the nip N formed by the thermoroll 2 and the backing roll 21. To the thermoroll 2 is supplied internal thermal power E1 by means of internal heating means 5, and external thermal power E2 by means of external heating means 13.

During running, the thermal powers E1 and E2 are divided in such a way that they will form as even as possible temperature distribution in the radial direction of the roll 2, as was described in connection with the previous embodiment.

Before the moment of changing the grade, the internal heating means 5 are used to adjust the internal thermal power E1 of the thermoroll 2, and thus the internal temperature. The internal thermal power E1 is adjusted so that the internal temperature of the thermoroll 2 will increase evenly within a specific period, for example, from 80 degrees centigrade to 148 degrees centigrade. By using the heating means, especially the induction heating elements of the external heating means 13, the temperature of the thermoroll 2 can be increased considerably if necessary, even to as high an 400 degrees centigrade.

Since the thermal power will also increase in the surface parts of the thermoroll 2 when the internal thermal power E1 is increased, the temperature of the external part of the thermoroll 2, for example, the temperature of the surface of the roll mantle also tends to increase due to the conduction of heat.

The external thermal power E2 obtained by means of the external heating means 13 is decreased at the some time as the internal thermal power 131 is increased. Decreasing the external thermal power E2 can be carried out, for example, by decreasing the power supplied to the induction heating element of the external heating means 13 programmatically by means of the control apparatus 12*b*. This decrease in external thermal power E2 compensates for the increase in the surface temperature of the thermoroll 2 due to the increase in internal thermal power E1 and maintains the temperature of the surface of the roll mantle 4 of the thermoroll 2 at the temperature required by the grade of the material web W being run. This also ensures that the thermoroll 2 releases heat to the outside, that is, to the web material W, at the correct thermal power E3 at the same time as the temperature of the inner parts of the thermoroll 2 is increased.

The internal power E1 is increased within a specific period until the temperature of the inner parts has increased to correspond to the second grade of web material W, or as high as possible close to the second grade of the web material W, taking into account the structure of the roll. Within the same specific period, the external power E2 supplied by means of an external heating means is decreased, for example, programmatically in such a way that the surface and surface parts of the thermoroll 2 will remain at a constant temperature and from the surface of the roll 2 will be transferred heat to the paper web W, at the nip N, at the thermal power E3 corresponding to the first grade. After this the external power E2 and thus the temperature of the external parts of the roll 2 can be rapidly increased to correspond to the second grade. During the increase of the external power E2 takes place the actual change of grade, that is, no grade is run through the nip N, although the material web W is run through it. Once the external thermal power E2 has been increased so high that the thermal power released by the thermoroll and the temperature of the surface parts of the thermoroll 2 correspond essentially to the second grade, the running of the second grade through the nip N may be started.

The thermal power released after the change of grade in the example case is about 75–90 kW/meter (in the lateral direction of the web) and the temperature 148 degrees centigrade. These figures are indicative. The thermal powers change depending on the grade of the web and the structure of the roll. Also the period of contact of the web with the thermoroll 2 effects the transfer of thermal power E3 to the web.

In this way, the grade of the material web W can be run at the same time as the time-consuming changing of the temperature (that is, increasing or decreasing) of the inner parts of the thermoroll 2 has already been started or brought close to the second grade to correspond or even equal to the second grade.

That which is claimed:

1. A method of cooling a heated roll in a calender having a nip formed between the heated roll and an adjacent backing roll, the nip being adapted to have a material web conveyed therethrough, the heated roll having a mantle with an external surface adapted to contact the web in the nip, the external surface being heated by thermal energy from an internal heating device disposed within the heated roll and thermal energy from an external heating device disposed outwardly thereof, the internal and external heating devices cooperating to control the external surface at a process temperature for producing a corresponding grade of the web, said method comprising:

decreasing the thermal energy provided to the external surface by the internal heating device;

increasing the thermal energy provided to the external surface by the external heating device as necessary to maintain the external surface at the process temperature;

minimizing the thermal energy provided to the external surface by the external heating device, after the thermal energy provided by the internal heating device is decreased to a minimum level, so as to cool the external surface, thereby allowing the grade of the web to be produced until the thermal energy provided by the internal heating device is decreased to the minimum level.

2. A method according to claim 1 further comprising monitoring a temperature of the external surface of the mantle with a sensor.

3. A method according to claim 1 further comprising controlling the thermal energy provided by at least one of the internal heating device and the external heating device with a controller in communication therewith.

4. A method according to claim 1 further comprising controlling the thermal energy provided by at least one of the internal heating device and the external heating device with a controller in communication with and responsive to a sensor configured to monitor a temperature of the external surface of the mantle.

5. A method according to claim 1 further comprising providing thermal energy to the mantle with an internal heating device selected from the group consisting of a heated medium circulating through a plurality of ducts extending through the mantle and at least one induction-heating device disposed within the mantle.

6. A method according to claim 1 further comprising providing thermal energy to the external surface of the mantle with an external heating device selected from the group consisting of an induction-heating device, an infrared heater and hot air fan.

7. A method according to claim 1 further comprising directing the internal heating device and the external heating device to cooperate to maintain the process temperature of the external surface of the mantle between about 30° C. and about 400° C.

8. A method according to claim 1 further comprising directing the internal heating device and the external heating device to cooperate to maintain the process temperature of the external surface of the mantle between about 30° C. and about 200° C.

9. A method of cooling a heated roll in a calender having a nip formed between the heated roll and an adjacent backing roll, the nip being adapted to have a material web conveyed therethrough, the heated roll having a mantle with an external surface adapted to contact the web in the nip, the external surface being heated by thermal energy from an internal heating device disposed within the heated roll and thermal energy from an external heating device disposed outwardly thereof, the internal and external heating devices cooperating to control the external surface at a first process temperature for producing a first grade of the web, said method comprising:

altering the thermal energy provided to the external surface by the internal heating device;

altering the thermal energy provided to the external surface by the external heating device as necessary to maintain the external surface at the first process temperature;

altering the thermal energy provided to the external surface by the external heating device as necessary, after the thermal energy provided by the internal heating device is altered to a set level corresponding to a second process temperature for producing a second grade of the web, so as to change the external surface to the second process temperature, thereby allowing production of the first grade of the web until the thermal energy provided by the internal heating device is changed to the set level and thereafter allowing production of the second grade of the web to begin when the external surface is changed to the second process temperature.

10. A method according to claim 9 further comprising monitoring a temperature of the external surface of the mantle with a sensor.

11. A method according to claim 9 further comprising controlling the thermal energy provided by at least one of the internal heating device and the external heating device with a controller in communication therewith.

12. A method according to claim 9 further comprising controlling the thermal energy provided by at least one of the internal heating device and the external heating device with a controller in communication with and responsive to a sensor configured to monitor a temperature of the external surface of the mantle.

13. A method according to claim 9 further comprising providing thermal energy to the mantle with an internal heating device selected from the group consisting of a heated medium circulating through a plurality of ducts extending through the mantle and at least one induction-heating device disposed within the mantle.

14. A method according to claim 9 further comprising providing thermal energy to the external surface of the mantle with an external heating device selected from the group consisting of an induction-heating device, an infrared heater and hot air fan.

15. A method according to claim 9 further comprising directing the internal heating device and the external heating device to cooperate to maintain at least one of the first process temperature and the second process temperature of the external surface of the mantle between about 30° C. and about 400° C.

16. A method according to claim 9 further comprising directing the internal heating device and the external heating device to cooperate to maintain at least one of the first process temperature and the second process temperature of the external surface of the mantle between about 30° C. and about 200° C.

* * * * *